US007314995B2

(12) United States Patent
Muramatsu

(10) Patent No.: US 7,314,995 B2
(45) Date of Patent: Jan. 1, 2008

(54) DATA ACQUISITION SYSTEM PREPARING INNER FORCE SENSE DATA FOR INNER SENSE CONTROLLER

(75) Inventor: Shigeru Muramatsu, Shizuoka (JP)

(73) Assignee: Yamaha Corporation, Shizuoka-Ken (JP)

( * ) Notice: Subject to any disclaimer, the term of this patent is extended or adjusted under 35 U.S.C. 154(b) by 281 days.

(21) Appl. No.: 11/265,222

(22) Filed: Nov. 1, 2005

(65) Prior Publication Data

US 2006/0090633 A1 May 4, 2006

(30) Foreign Application Priority Data

Nov. 1, 2004 (JP) ..... 2004-318479

(51) Int. Cl.
*G10H 1/02* (2006.01)
*G10H 5/00* (2006.01)

(52) U.S. Cl. ..... 84/744; 84/626; 84/658; 84/719

(58) Field of Classification Search ..... None
See application file for complete search history.

(56) References Cited

U.S. PATENT DOCUMENTS 5,922,983 A 7/1999 Muramatsu
6,121,535 A * 9/2000 Muramatsu ..... 84/626
6,297,437 B1 * 10/2001 Ura et al. ..... 84/423 R
6,403,872 B2 * 6/2002 Muramatsu et al. ..... 84/724

FOREIGN PATENT DOCUMENTS

| | | |
|---|---|---|
| JP | 10-177378 | 6/1998 |
| JP | 2004-94284 | 3/2004 |
| JP | 2004-94285 | 3/2004 |

* cited by examiner

*Primary Examiner*—Marlon Fletcher
(74) *Attorney, Agent, or Firm*—Harness, Dickey & Pierce, PLC

(57) ABSTRACT

A data acquisition system is used in the transplantation of the piano key touch from an acoustic piano to an electronic piano, and the function thereof is broken down into a table producer, a motion controller and a servo-controller; a table, which expresses relation between current key positions and the amount of current supplied to key actuators, is stored in the table producer; the table producer supplies pieces of test data to the motion controller, which determines reference test trajectories, and the servo-controller forces the keys to travel thereon through the key actuators; sensors reports the current key positions and current key velocity to the table producer, and the table producer produces tables expressing pieces of inner force data through the analysis on these data; the tables are supplied to an inner force sense controlling system, which reproduce the key touch in the electronic piano.

20 Claims, 7 Drawing Sheets

DATA ACQUISITION SYSTEM PREPARING INNER FORCE SENSE DATA FOR INNER SENSE CONTROLLER

FIELD OF THE INVENTION

This invention relates to an inner force sense controlling system and, more particularly, to a data acquisition system for an inner force sense controller provided in association with a musical instrument.

DESCRIPTION OF THE RELATED ART

A typical example of the inner force sense controller is disclosed in Japanese Patent Application laid-open No. Hei 10-177378, and the prior art inner force sense controller is used for a keyboard musical instrument such as, for example, an electronic piano. Acoustic pianos give unique key touch to the players, and the players feel the key touch on the electronic pianos different from the unique key touch on the acoustic pianos. Players, who are familiar with the acoustic pianos, wish to play pieces of music on the electronic pianos in the key touch close to the unique piano key touch.

The prior art inner force sense controller is offered to those players, and aims at properly imparting reactive force against the key motion. The prior art inner force controller includes key sensors, key drive actuators and a data processing system, and tables, the contents of which respectively relate to the current key position, key velocity and key acceleration, are prepared in the data processing system. The key sensors monitor the keys, and supply the key position signals to the data processing system. The data processing system determines the current key velocity and current key acceleration on the basis of the variation of the current key position, and reads out pieces of inner force sense data, which correspond to three combinations of current key position, current key velocity and current key acceleration, from the tables, respectively. The data processing system determines a piece of control data on the basis of the pieces of inner force sense data and the piece of key position data, and regulates a driving signal to a proper duty ratio expressed by the piece of control data. The data processing system supplies the driving signal to the key drive actuators so that the reactive force against the key motion is varied depending upon the duty ratio. Thus, the prior art inner force sense controller imparts the variable reactive force to the fingers of the human player.

When the manufacturer designs the tables to simulate the unique piano key touch, the prior art inner force sense controller causes the human player to feel the key touch on the electronic piano analogous to the unique piano key touch. In case where the unique piano key touch is roughly simulated with the pieces of inner force sense data, the human player may feel the key touch on the electronic piano a little analogous to the unique piano key touch: However, the human player can distinguish the key touch on the electronic piano from the unique piano key touch. On the other hand, when the manufacturer accurately simulates the unique piano key touch with the pieces of inner force sense data, the human player feels the key touch on the electronic piano very close to the unique piano key touch. Thus, the pieces of inner force sense data are the important factors to give rise to the target inner force sense in the human player.

The manufacturer prepared the pieces of inner force sense data through a trial and error method. A human researcher wrote pieces of inner force sense data in the tables, and depressed the keys to see whether or not the prior art inner force sense controller gave rise to the unique piano key touch. If the human researcher felt the key touch on the electronic piano different from the unique piano key touch, he or she rewrote the pieces of inner force sense data, and depressed the keys, again. The human researcher repeated the above-described steps until the prior art inner force sense controller satisfied him or her. Thus, human researcher consumes a large amount of time and labor for the data acquisition work. This is a problem inherent in the prior art inner force sense controller.

SUMMARY OF THE INVENTION

It is therefore an important object of the present invention to provide a data acquisition system, which prepares pieces of inner force sense data representative of inner force sensing characteristics of a musical instrument.

To accomplish the object, the present invention proposes to analyze relation between the magnitude of force exerted on manipulators and physical quantity expressing motion of the manipulators along reference test trajectory for producing pieces of inner force sense data.

In accordance with one aspect of the present invention, there is provided a data acquisition system for preparing pieces of inner force sense data expressing a touch on manipulators of a musical instrument comprising plural actuators provided in association with the manipulators, and responsive to driving signals so as to give rise to motion of the manipulators along reference test trajectories, plural sensors producing detecting signals representative of physical quantity expressing said motion of said manipulators, other sensors producing other detecting signals representative of the magnitude of force exerted on the manipulators by means of the plural actuators along the reference test trajectories, and a controller connected to the plural actuators, the plural sensors and the other sensors, responsive to pieces of test data so as to give rise to the motion of the manipulators by means of the plural actuators and analyzing the physical quantity and the magnitude of said force so as to determine relation between the motion and the magnitude of force along the reference test trajectories, thereby preparing the pieces of inner force sense data on the basis of the relation for manipulators of another musical instrument.

BRIEF DESCRIPTION OF THE DRAWINGS

The features and advantages of the data acquisition system will be more clearly understood from the following description taken in conjunction with the accompanying drawings, in which.

DESCRIPTION OF THE PREFERRED EMBODIMENTS

Figure 1:
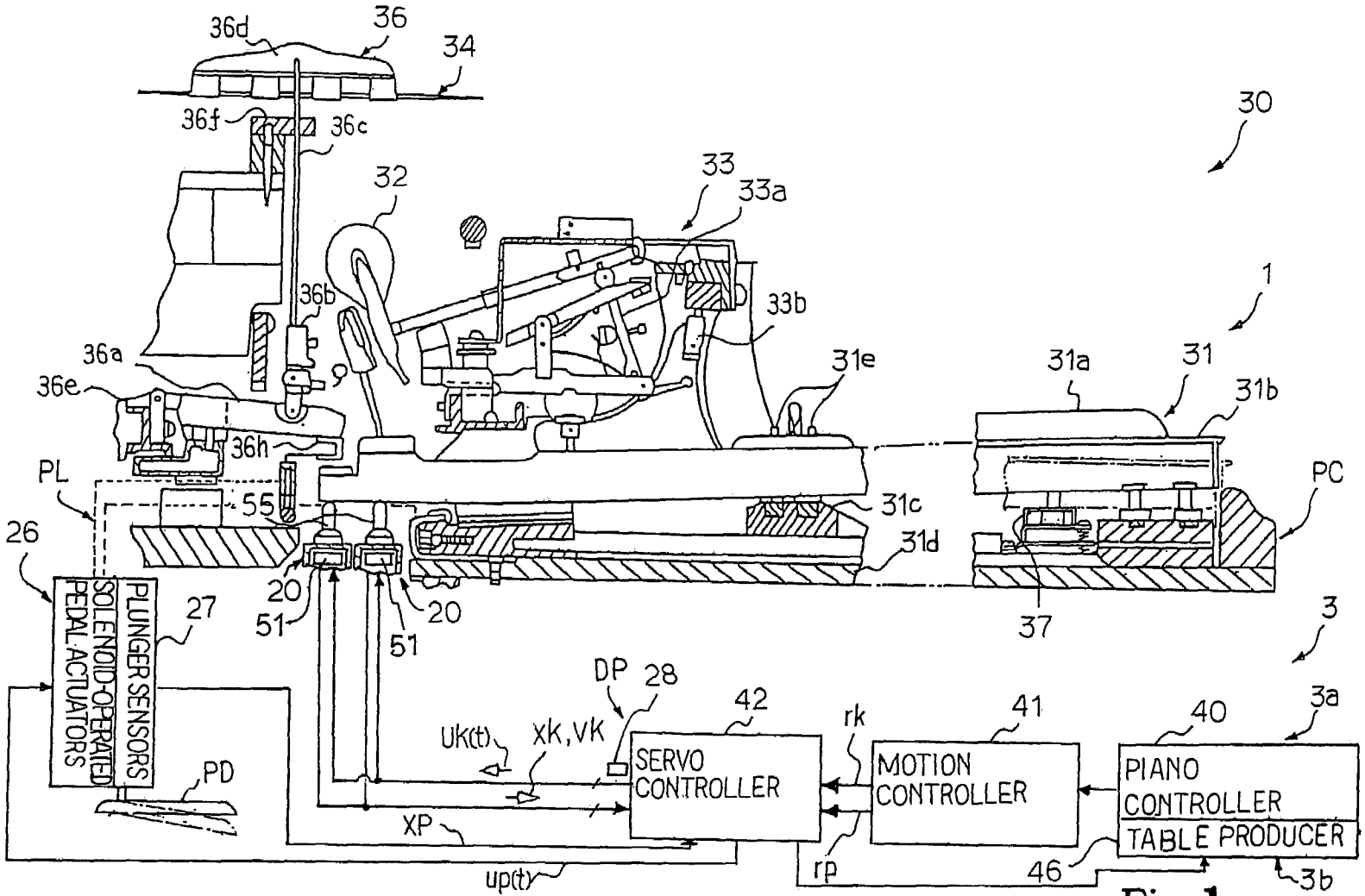
FIG. 1 is a side view showing the structure of an automatic player piano equipped with a data acquisition system of the present invention.

A data acquisition system embodying the present invention is provided for a musical instrument, which includes manipulators for tones to be produced. When a user manipulates each manipulator, the manipulator travels on a trajectory, and makes the user feel reactive force. The tactile sense due to the reactive force along the trajectory is called as "touch". The data acquisition system prepares pieces of inner force sense data representative of the touch of the manipulators for another musical instrument. The pieces of inner force sense data are available for reproduction of the touch on manipulators of another musical instrument.

The data acquisition system largely comprises plural actuators, plural sensors, other sensors and a controller, and the controller is connected to the other system components, i.e., the plural actuators, plural sensors and other sensors. Thus, the controller selectively energizes the plural actuators so as to gather pieces of motion data representative of physical quantity of the manipulators and pieces of force data representative of the magnitude of force exerted on the manipulators for analysis carried out therein.

In more detail, the plural actuators are provided in association with the manipulators, and are responsive to driving signals, which are supplied from the controller, so as to give rise to the motion of the manipulators along reference test trajectories. The plural sensors monitor either plural actuators or manipulators, and produce detecting signals representative of the physical quantity, which expresses the motion of the manipulators. The other sensors monitors the plural actuators, and produces other detecting signals representative of the magnitude of the force exerted on the manipulators by means of the plural actuators along the reference test trajectories. Since the magnitude of force is proportional to the amount of energy supplied to the plural actuators, the other sensors may monitor the driving signals.

First, pieces of test data are supplied to the controller. The pieces of test data express the motion of the manipulators, and the trajectory of each manipulator is referred to as the "reference test trajectory". The controller supplies the driving signals to the plural actuators so as to give rise to the motion of the manipulators defined by the pieces of test data. The plural actuators are energized with the driving signals. Then, the plural actuators start to exert the force on the manipulators, and force the manipulators to travel on the reference test trajectories.

While the manipulators are traveling on the reference test trajectories, the plural sensors convert the physical quantity of the manipulators to detecting signals, and the other sensors convert the magnitude of the energy supplied to the plural actuators to other detecting signals. The detecting signals and other detecting signals are input into the controller.

The controller analyzes the physical quantity and the magnitude of the force, and determines relation between the motion and the magnitude of force along said reference test trajectories through the analysis. When the relation is abruptly changed, the player feels the load on the manipulator varied. On the other hand, while the relation is being constant, the player feels the load constant. Thus, the relation stands for the inner force sense. For this reason, the controller prepares the pieces of inner force sense data on the basis of the relation for the manipulators of another musical instrument.

In the following description, term "front" is indicative of a position closer to a player, who is sitting on a stool for fingering, than a position modified with term "rear". A line drawn between a front position and a corresponding rear position extends in a "fore-and-aft direction", and a "lateral direction" crosses the fore-and-aft direction at right angle. A vertical direction is normal to a plane defined by the fore-and-aft direction and the lateral direction.

First Embodiment

Referring first to FIG. 1 of the drawings, a data acquisition system embodying the present invention is incorporated in an automatic player piano 30, which largely comprises an acoustic piano 1 and an electronic system 3. The acoustic piano 1 is operative to produce acoustic piano tones without any assistance of the electronic system 3. On the other hand, the electronic system 3 cooperates with the acoustic piano 1. The electronic system 3 reenacts a performance on the acoustic piano 1, and prepares pieces of inner force sense data on the basis of the actions in the acoustic piano 1. Thus, the electronic system 3 serves as at least an automatic playing system 3*a* and a data acquisition system 3*b*. Although the electronic system 3 further serve as a recording system, which converts the performance on the acoustic piano 1 into a set of music data codes, description is omitted for the sake of simplicity. Key sensors 37 form parts of the recording system.

The automatic playing system 3*a* reenacts a performance on the basis of pieces of music data, which are expressed in a set of music data codes. In this instance, the set of music data codes is formatted in accordance with the MIDI (Musical Instrument Digital Interface) protocols. When a user instructs the automatic playing system 3*a* to reenact the performance expressed by the set of music data codes, the set of music data codes is loaded into the automatic playing system 3*a*. The automatic playing system 3*a* starts to measure the lapse of time, and searches the set of music data codes for a music data code or codes to be processed now. When a music data code is found, the automatic playing system 3*a* specifies a manipulator such as a key or a pedal of the acoustic piano 1 to be moved, and drives the manipulator to produce the tone.

The control sequence to drive the manipulator is described in more detail. One of the functions of the automatic playing system 3*a* is expressed as a "piano controller 40", another function and yet another function are expressed as a "motion controller 41" and a "servo-controller 42", respectively. The piano controller 40 searches the set of music data codes for a music data code or codes to be presently processed, and supplies the music data code or codes, which are found through the search, to the motion controller 41.

The motion controller 41 determines a reference trajectory for the manipulator on the basis of the music data code. The reference trajectory is a series of values of a target position which are varied together with time. The motion controller 41 measures the lapse of time, and periodically supplies the pieces of position data rk or rp representative of the current target position on the reference trajectory to the servo-controller 42. The reference "rk" represents the pieces of position data representative of the target position of the key, and the reference "rp" stands for the pieces of position data representative of the target position of the pedal.

When a piece of position data rk or rp reaches the servo-controller 42, the servo-controller 42 determines the magnitude of force to be exerted on the manipulator. The servo-controller 42 forms servo-control loops for the manipulators, and keeps, increases or decreases the magnitude of force through the associated servo-control loop depending upon deviation between the reference trajectory and an actual trajectory. In other words, the servo-controller 42 forces the manipulators to travel on the reference trajectories through the servo-control loops. If the manipulator exactly traces the actual trajectory without deviation from the reference trajectory, the motion of the manipulator results in the acoustic tone same as that produced in the original performance. Thus, the automatic playing system 3*a* gives rise to the original motion of manipulators so as to reenact the original performance.

The data acquisition system 3*b* includes a table producer 46, which expresses a part of the function of the data acquisition system 3*b*, the motion controller 41, servo controller 42, which express other parts of the function of the data acquisition system 3*b* and force sensors 28. The force sensors measure the force exerted on the black and white keys 31*a*/31*b*, and the force is equivalent to the reactive force on the fingers of a human player. Although the motion controller 41 and servo-controller 42 behave similarly to those of the automatic playing system 3*a*, the table producer 46 behaves differently from the piano controller 40.

The table producer 46 supplies pieces of test data to the motion controller 41. The motion controller 41 determines reference test trajectories on the basis of the pieces of test data. One of the reference test trajectories causes the manipulator to make brief stops thereon, another reference test trajectories expresses uniform motion of the manipulator, and yet another reference test trajectory expresses uniformly accelerated motion of the manipulator. The motion controller 41 periodically informs the servo-controller 42 of the target position on the reference test trajectory, and the servo controller 42 forces each of the manipulators to travel on the reference test trajectories at different values of velocity and reference test trajectories at different values of acceleration.

While the manipulator is traveling on the reference test trajectory, the current position, current velocity and magnitude of force are reported to the table producer 46. The table producer 46 determines relation between the magnitude of force and the current position at different values of current velocity. The table producer 46 calculates current acceleration on the actual trajectories, and determines relation between the magnitude of force and the current position at different values of current acceleration.

Thereafter, the table producer 46 recasts the relations into other three relations serving as pieces of inner force sense data. One of the other relations makes the magnitude of force correlated with the current position at different values of current velocity, another relation makes the magnitude of force correlated with the current velocity at different values of current position, and yet another relation makes the magnitude of force correlated with the current acceleration at different values of current position.

The relations or pieces of inner force sense data are transferable to the outside of the electronic system 3, and are available for an inner force sense controller.

Description is hereinafter made on the acoustic piano 1 and electronic system 3 in more detail with reference to the drawings.

Acoustic Piano

In this instance, the acoustic piano 1 is a standard grand piano. Of course, an upright piano is available for the automatic player piano 30. The acoustic piano 1 includes a keyboard 31, hammers 32, action units 33, strings 34, dampers 36, a piano cabinet PC and pedals PD. The keyboard 31 is mounted on a front portion of a piano cabinet PC, and is exposed to a pianist, who is sitting on a stool (not shown) in front of the piano cabinet PC for playing a piece of music. The action units 33, hammers 32, strings 34 and dampers 36 are housed inside the piano cabinet PC, and the inner space is open to the ambience while a top board (not shown) is folded. The action units 33 and dampers 36 are linked with the keyboard 31, and are selectively actuated by the pianist through the keyboard 31. The hammers 32 are actuated by the action units 33, and are rotated toward the strings 34. The hammers 32 are brought into collision with the strings 34 at the end of the rotation, and give rise to vibrations of the strings 34 for producing the acoustic piano tones.

The keyboard 31 includes black keys 31*a* and white keys 31*b*, and the black keys 31*a* and white keys 31*b* are laid on the well-known pattern. A balance rail 31*c* laterally extends over a key bed 31*d*, which defines the bottom of the piano cabinet PC, and the black keys 31*a* and white keys 31*b* rest on the balance rail 31*c* in such a manner as to cross the balance rail 31*c* at right angle. Balance pins 31*e* upwardly project from the balance rail 31*c* at intervals, and offer fulcrums to the black/white keys 31*a*/31*b*. When a user depresses the front end portions of the black and white keys 31*a*/31*b*, the front end portions are sunk toward the key bed 31*d*, and the rear portions are lifted. Thus, the black and white keys 31*a*/31*b* pitch up and down like a seesaw.

The black/white keys 31*a*/31*b* are respectively linked with the action units 33 so that depressed keys 31*a*/31*b* actuate the associated action units 33. The hammers 32 rest on the jacks 33*a*, which form parts of the action units 33 together with regulating buttons 33*b*. When the toes of the jacks 33*a* are brought into contact with the associated regulating buttons 33*b*, the jacks 33*a* escape from the associated hammers 32, and exert the force on the hammers 32. Then, the hammers 32 start the free rotation toward the associated strings 34. Thus, the hammers 32 are driven for the free rotation through the escape of the jacks 33*a*.

The strings 34 are stretched over the associated hammers 32, and are struck with the associated hammers 32 at the end of the free rotation. While the black and white keys 31*a*/31*b* are staying at the rest positions, the dampers 36 are held in contact with the associated strings 34, and prevent the associated strings 34 from vibrations. The depressed keys 31*a*/31*b* make the associated dampers 36 spaced from the strings 34 on the way to the end positions. Then, the strings 34 get ready for vibrations.

Each of the dampers 36 includes a damper lever 36*a*, a damper block 36*b*, a damper wire 36*c* and a damper head 36*d*. The damper lever 36*a* is rotatably supported by a damper lever flange 36*e*, and has a front end portion over the rear end portion of the associated black/white key 31*a*/31*b*. While the pianist is exerting the force on the front portion of the associated black/white key 31*a*/31*b*, the rear end portion rises, and upwardly pushes the front end portion of the damper lever 36*a*. Thus, the depressed black/white key 31*a*/31*b* gives rise to the rotation of the damper lever 36*a* about the damper lever flange 36*e*.

The damper block 36*b* is pivotally connected to the middle portion of the damper lever 36*a*, and the lower end of the damper wire 36*c* is embedded in the damper block

36*b*. The damper wire 36*c* is upright on the damper block 36*b*, and passes through a guide rail 36*f*. The damper wire 36*c* is connected at the upper end thereof to the damper head 36*d*, and a damper felt, which forms a part of the damper head 36*d*, is held in contact with the strings 34.

While the depressed black/white key 31*a*/31*b* is upwardly pushing the damper lever 36*a*, the force is transmitted from the damper lever 36*a* through the damper wire 36*c* to the damper head 36*d* so that the damper head 36*d* is spaced from the string 34. When the pianist releases the depressed black/white key 31*a*/31*b*, the rear portion of black/white key 31*a*/31*b* is sunk due to the self-weight of the damper 36, and the damper head 36*d* is brought into contact with the string 34, again. Thus, the dampers 36 prevent the associated strings 34 from vibrations, and permit the associated strings 34 to vibrate for producing the acoustic piano tones.

The pedals PD are provided under the key bed 31*d*, and are connected to a damper block 36*h*, a sostenuto rod and the keyboard 31 through a linkwork PL. One of the pedals PD is called as a "damper pedal", and makes the piano tones prolonged. Another of the pedals PD is called as a "soft pedal", and makes the piano tones reduced in loudness. Yet another pedal PD is called as a "sostenuto pedal", and makes particular tones prolonged. The damper pedal, soft pedal and sostenuto pedal drive the damper block 36*h*, keyboard 31 and sostenuto rod, respectively. While the human player is playing a piece of music on the acoustic piano 1, he or she selectively depresses and releases the black and white keys 31*a* and 31*b*, and sometimes steps on the pedals PD so as to put the artificial expression into the piano tones.

System Configuration of Electronic System

The electronic system 3, which serves as the automatic playing system 3*a*, includes a controller DP, an array of solenoid-operated key actuators 20 and solenoid-operated pedal actuators 26. In this instance, the black and white keys 31*a*/31*b* and pedals PD serve as the "manipulators" so that the solenoid-operated key actuators 20 and solenoid-operated pedal actuators 26 are provided for the black and white keys 31*a*/31*b* and pedals PD, respectively.

The controller DP has a data processing capability, and computer programs are installed therein. The solenoid-operated key actuators 20 and solenoid-operated pedal actuators 26 are connected to the controller DP.

The solenoid-operated key actuators 20 are provided under the rear portions of the black and white keys 31*a*/31*b*, and the controller DP selectively energizes the solenoid-operated key actuators 20 for driving the associated black and white keys 31*a*/31*b* without any fingering of a human player. The solenoid-operated pedal actuators 26 are provided over the rear portions of the pedals PD, and push down the associated pedals PD without any step-on of the human player. The total weight of the pedal system PD/PL/36, which the solenoid-operated pedal actuator 26 is expected to drive, is heavier than the total weight of the key/action unit/each damper 36/each hammer 32, which the solenoid-operated key actuator 20 is expected to drive. For this reason, the solenoid-operated pedal actuators 26 are expected to create the magnetic field stronger than that created by the solenoid-operated key actuators 20.

Figure 2:
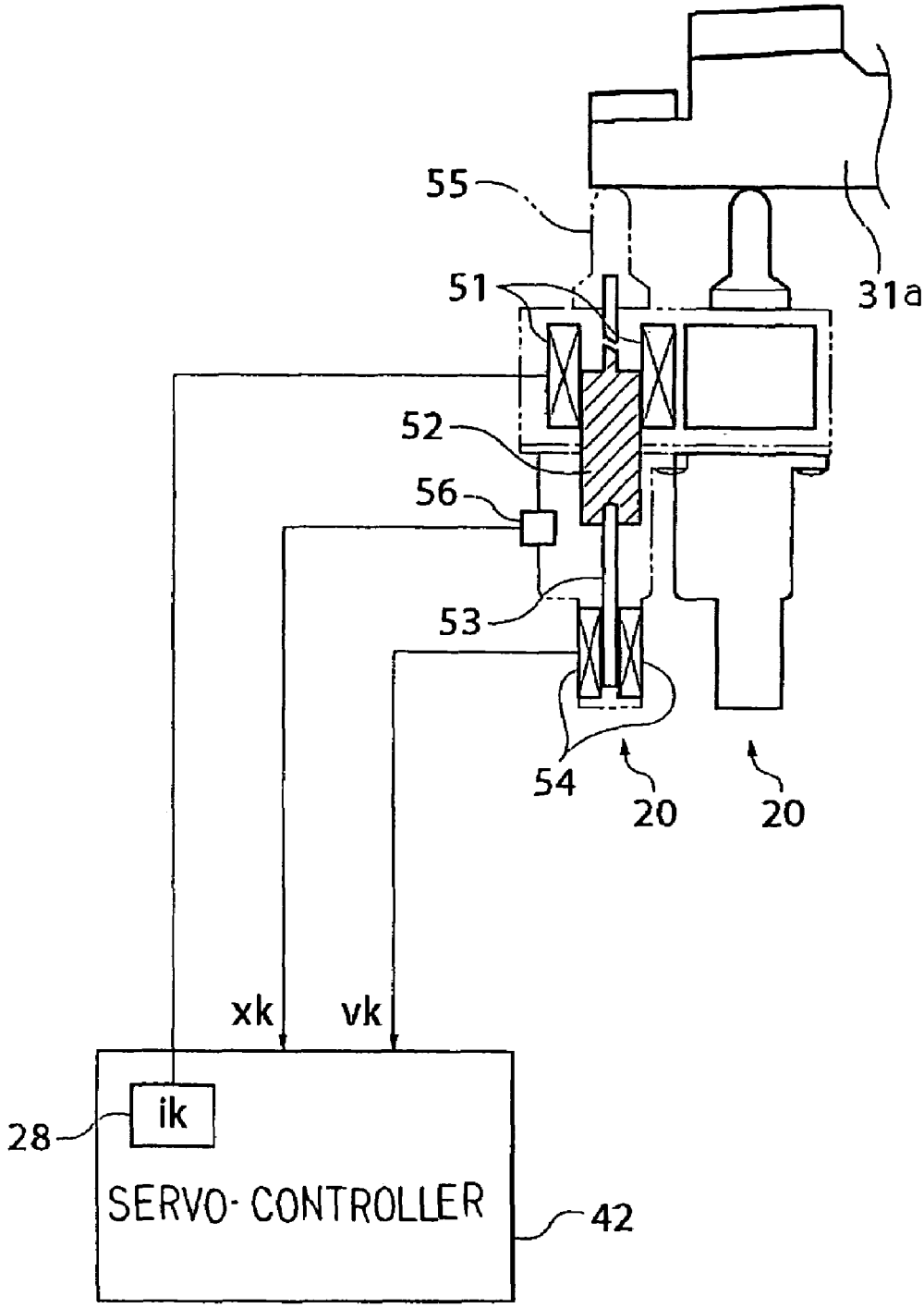
FIG. 2 is a schematic cross sectional view showing the structure of a solenoid-operated plunger actuator sensor with a built-in sensor incorporated in the automatic player piano.

As shown in FIG. 2, the solenoid-operated key actuators 20 have respective solenoids 51, respective plungers 52, respective built-in plunger velocity sensors each having a permanent magnetic rod 53 and a coil 54, respective resilient caps 55 and respective built-in plunger position sensors 56. The solenoid-operated key actuators 20 are identical in structure with one another. Though not shown in the drawings, a framework bears the solenoids 51, and is secured to the key bed 31*d*. The plungers 52 are inserted into the associated solenoids 51, and electric current, which flows through the solenoids 51, creates magnetic fields around the plungers 52 so as to exert magnetic force on the plungers 52. The magnetic force makes the plungers 52 move in the up-and-down direction.

The resilient caps 55 are respectively connected to the upper ends of the plungers 52, and the tips of the resilient caps 55 are in the close proximity of the lower surfaces of the rear portions of the black and white keys 31*a*/31*b* while the plungers 52 are retracted in the associated solenoids 51. The permanent magnetic rods 53 are connected to the lower ends of the plungers 52, and are moved inside the coils 54. While the permanent magnetic rod 53 is moved inside the coil 54, electric current flows through the coil 54 due to the electromotive force, and the amount of electric current is proportional to the velocity of the permanent magnetic rod 53 and, accordingly, the velocity of the plunger 52. The electric current expresses the velocity of the plunger 52, and serves as a plunger position signal vk. In this instance, the plunger velocity is expressed in millimeter per second.

The built-in plunger position sensor 56 is, by ways of example, implemented by a photo reflector supported by the framework (not shown) and a gray scale attached to the plunger 52. The amount of incident light output from the photo reflector is varied together with the current plunger position, and serves as a plunger position signal xk. The current plunger position is equivalent to the plunger stroke from the rest position, and is expressed in millimeters.

Turning back to FIG. 1, the solenoid-operated pedal actuators 26 have respective built-in plunger sensors 27, respective solenoids and respective plungers. The plungers 29 form parts of the link works PL, and the built-in plunger sensors 27 monitors the associated plungers. While electric current is flowing the solenoids, the magnetic force is exerted on the plungers, and the plungers are moved in the up-and-down direction. The plungers drive the dampers block 36*h*, keyboard 31 and sostenuto rod as if the human player steps on the pedals PD.

While the automatic playing system 3*a* is reenacting a performance, the plunger velocity signals vk, plunger position signals xk and plunger position signals xp are supplied to the servo-controller 42, and servo-controller 42 forces the black/white keys 31*a*/31*b* and pedals PD to travel on the reference key trajectories and reference pedal trajectories. Thus, the solenoid-operated key actuators 51/52/55 and built-in sensors 53/54 and 56 form in combination the servo-control loops for the black and white keys 31*a*/31*b* together with the servo-controller 42, and the solenoid-operated pedal actuators 26 and built-in pedal sensors 27 form the servo-control loops for the pedals PD together with the servo-controller 42.

While the servo-controller 42 is serving as the part of the data acquisition system 3*b*, pieces of velocity data vk, which are expressed by the plunger velocity signals vk, pieces of position data xk, which are expressed by the plunger position signals xp, and pieces of force data pk, which express the amount of current ik passing through the solenoids 51, are transferred from the servo-controller 42 and ammeters 28, which serve as the force sensors 28 as will be hereinlater described in detail, to the table producer 46.

When a user wishes to reproduce a performance, the user instructs the controller DP to get ready for a playback, and a set of MIDI music data codes, which represents the performance, is loaded to the controller DP. The piano controller 40 searches the set of MIDI music data codes for a MIDI music data code or codes to be presently processed. When the piano controller 40 finds the MIDI music data code or codes to be presently processed, the piano controller 40 sends the MIDI music data code or codes to the motion controller 41.

The motion controller 41 processes the MIDI music data code or codes so as to determine the reference key trajectory or trajectories on which the black and white keys 31*a*/31*b* are to travel. If the black and white keys 31*a*/31*b* exactly travel along the reference key trajectories, the black and white keys 31*a*/31*b* pass respective reference key points at target values of reference key velocity. Since the reference key velocity is proportional to the hammer velocity immediately before the impact on the strings 34, the acoustic piano tones are produced at target values of loudness. Thus, the black and white keys 31*a*/31*b* on the reference key trajectories guide the associated hammers 32 to the target hammer velocity so as to produce the acoustic piano tones at the target loudness.

The motion controller 41 periodically supplies the pieces of position data expressing the target key positions to the servo-controller 42. As described hereinbefore, the plunger position signals xk and plunger velocity signals xv are supplied from the built-in plunger sensors 56 and built-in plunger sensors 53/54 to the servo controller 42 so that the servo controller 42 periodically acquires the pieces of knowledge of the current plunger positions and current plunger velocity. The servo controller 42 compares the target key positions and target key velocity, which is calculated on the basis of series of target key positions, with the current plunger positions and current plunger velocity, respectively, and determines the amount of mean current to be supplied to the solenoids 51 in such a manner that the difference between the current plunger position and the target plunger position and difference between the current plunger velocity and the target key velocity are minimized.

The servo controller 42 adjusts driving signal uk(t) to the amount of mean current with the assistance of a pulse width modulator 42*a* (see FIG. 3), and supplies the driving signals uk(t) to the solenoid-operated key actuators 20 under the black and white keys 31*a*/31*b*. Then, the plungers 52 start to project upwardly, and the resilient caps 55 push the rear portions of the certain keys 31*a*/31*b*. The built-in plunger sensors 53/54 and 56 report the current plunger position, which is almost equivalent to the current key position, through the plunger position signal xk and the current plunger velocity through the plunger velocity signal vk to the servo controller 42.

When the motion controller 41 supplies the next target plunger position to the servo-controller 42, the servo controller 42 repeats the above-described control sequence, again. If the answer is given negative, the servo controller 42 varies the mean current of the driving signal uk(t) so as to accelerate or decelerate the plunger 52. On the other hand, when the servo controller 42 confirms that the certain keys 31*a*/31*b* accurately travel on the reference key trajectories, the servo controller 42 keep the driving signals uk(t) at the mean current. Thus, the servo controller 42 sequentially drives the plungers 52 so as to give rise to the key motion same as that in the original performance. The black and white keys 31*a*/31*b* actuate the associated action units 33, and cause the hammers 32 to be brought into collision with the associated strings 34 at the end of the free rotation for producing the acoustic piano tones.

The human player sometimes prolonged an acoustic piano tone in the original performance. When the timing at which the prolonged acoustic piano tone is to be reproduced in the playback, the motion controller 41 also determines the reference pedal trajectory for the damper pedal PD, and starts periodically to supply the pieces of target plunger position data to the servo controller 42. The servo controller 42 behaves in a similar manner to that in the servo control to the black and white keys 31*a*/31*b*, and forces the pedals PD to travel on the reference pedal trajectories with driving signals up(t).

The electronic system 3, which serves as the data-acquisition system 3*b*, includes the table producer 46, motion controller 41, servo controller 42, solenoid-operated key actuators 20 with built-in plunger sensors 53/54 and 56 and the ammeters 28. In this instance, the ammeters 28 are implemented by Hall elements. The Hall elements convert the strength of magnetic field to the amount of current passing therethrough so that the amount of current passing through the Hall elements is proportional to the amount of current ik passing through the solenoids 51. Since the amount of current ik is proportional to the magnetic force exerted on the black and white keys 31*a*/31*b*, the amount of current passing through the Hall elements is further proportional to the magnetic force or thrust exerted on the black and white keys 31*a*/31*b*. The human player feels the thrust as the reactive force at his or her fingers. Thus, the amount of current passing through the Hall elements expresses the reactive force. Though not shown in the drawings, the amount of electric current, which passes through the Hall elements, is sampled and converted to digital signals representative of the pieces of force data pk.

Although it is possible directly to measure the magnitude of reactive force by means of load sensors, the Hall elements are preferable to the load sensors, because part of the reactive force is unavoidably consumed by the load sensors.

Figure 3:
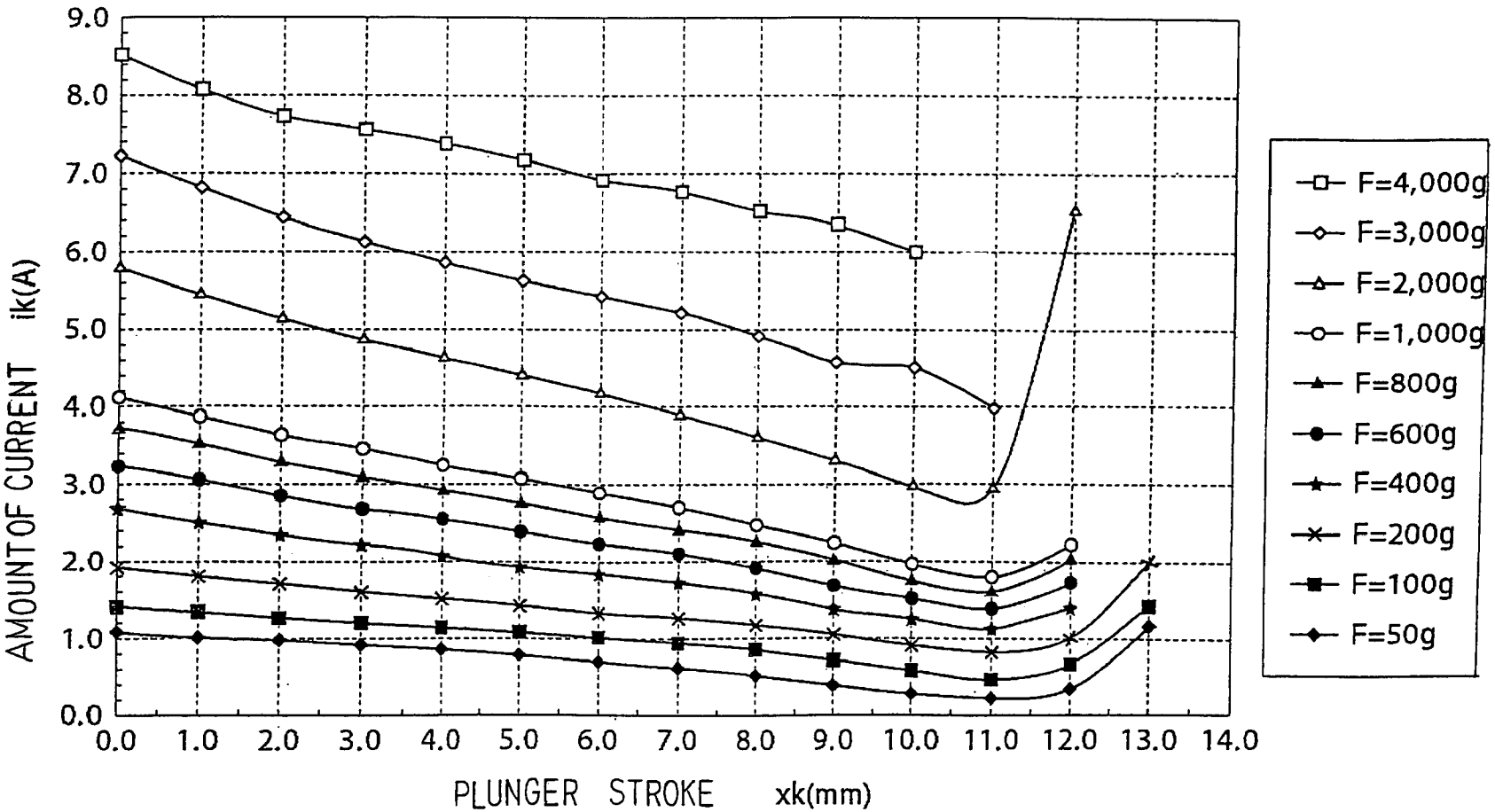
FIG. 3 is a graph showing relation between the amount of supplied current and a plunger stroke at different magnitudes of reactive force.

The function of the table producer 46 has been briefly described. The table producer 46 is hereinafter described in more detail with reference to FIGS. 3 and 4. FIG. 3 shows a graph stored in the form of table in the table producer 46. The table expresses relation between the current plunger position xk or the plunger stroke and the amount of current ik, which passes through the solenoids 51 at different values of the magnetic force or thrust F exerted on the black and white keys 31*a*/31*b*, and the relation was determined through experiments for each of the black and white keys 31*a*/31*b*. In this instance, the plunger stroke xk was changed at intervals of 1 millimeter, and the thrust F was changed from 50 grams to 4,000 grams. Reference marks of plots are correlated with the values of thrust on the right side of the graph. The thrust F was measured by means of load cells. Since the thrust F is stepwise changed, the relation between the plunger stroke xk and the amount of current ik at a certain value of thrust between the plots is determined through the interpolation.

The table producer 46 tables the pieces of inner force sense data as follows. As described hereinbefore, when a user instructs the controller DP to prepare the pieces of inner force sense data, the table producer 46 supplies the pieces of test data to the motion controller 41, and the motion controller 41 determines the reference test trajectories for all the black and white keys 31*a*/31*b*. The reference test trajectories are broken down into three categories. The first category contains the reference test trajectories on which the black and white keys 31*a*/31*b* make brief stops at predetermined intervals. The second category contains the reference test trajectories for the uniform key motion, and the third category stands for the uniformly accelerated key motion. The table producer 46 carries out the following experiments for each of the black and white keys 31*a*/31*b*.

The table producer 46 supplies the pieces of test data for the stepwise key motion to the motion controller 41. The motion controller 41 determines the reference test trajectories for the stepwise key motion between the rest position and the end position, and periodically informs of the target key position rk on the reference test trajectories to the servo-controller 42. The plunger 52 stepwise projects, and makes brief stops at the predetermined intervals. Accordingly, the associated black and white key 31*a*/31*b* makes brief stops at the predetermined intervals. When the plunger 52 makes the brief stops on the reference test trajectories, the table producer 46 determines the amount of current ik or a piece of force data pk, and pairs the piece of force data pk with the piece of key position data xk expressing the plunger stroke. Thus, the table producer 46 accumulates the pieces of power data pk respectively paired with the pieces of key position data xk inside thereof.

Subsequently, the table producer 46 supplies the pieces of test data for the uniform key motion at a certain value of key velocity to the motion controller 41, and the motion controller 41 determines the reference key trajectories between the rest position and the end position. The motion controller 41 periodically informs the servo controller 42 of the target key positions rk on the reference test trajectories. The servo controller 42 gives rise to the uniform plunger motion and, accordingly, the uniform key motion along the reference test trajectories. The table producer 46 determines the amount of current ik at each of the predetermined actual key positions, and accumulates the pieces of force data pk respectively paired with the pieces of key position data xk inside thereof. The table producer 46 changes the key velocity from the certain value to another value, and supplies the pieces of test data expressing the reference test trajectories for the uniform key motion at another value of the key velocity so that pieces of force data pk are accumulated together with the pieces of key position data xk. In this manner, the table producer 46 sequentially supplies the pieces of test data expressing the reference test trajectories for the uniform key motion at different values of key velocity to the motion controller 41, and accumulates the sets of pieces of force data pk and associated pieces of key position data xk inside thereof. The key velocity is changed predetermined times n. In this instance, n ranges from 20 to 30.

Subsequently, the table producer 46 supplies the pieces of test data for the uniformly accelerated key motion at a certain value of the acceleration to the motion controller 41, and the motion controller 41 determines the reference key trajectories between the rest position and the end position. The motion controller 41 periodically informs the servo controller 42 of the target key positions rk on the reference test trajectories. The servo controller 42 gives rise to the uniformly accelerated plunger motion and, accordingly, the uniformly accelerated key motion along the reference test trajectories. The acceleration is determined through the differentiation on the piece of key velocity data vk. The table producer 46 determines the amount of current ik at predetermined actual key positions, and accumulates pieces of force data pk respectively paired with the pieces of key position data xk inside thereof. The table producer 46 changes the key acceleration to another value, and supplies the pieces of test data expressing the reference test trajectories for the uniformly accelerated key motion at another value so that pieces of force data pk are accumulated together with the pieces of key position data xk. In this manner, the table producer 46 sequentially supplies the pieces of test data expressing the reference test trajectories for the uniform key motion at different values of key acceleration to the motion controller 41, and accumulates the sets of pieces of force data pk and associated pieces of key position data xk inside thereof. The key acceleration is changed predetermined times n. In this instance, n ranges from 20 to 30.

Figure 4:
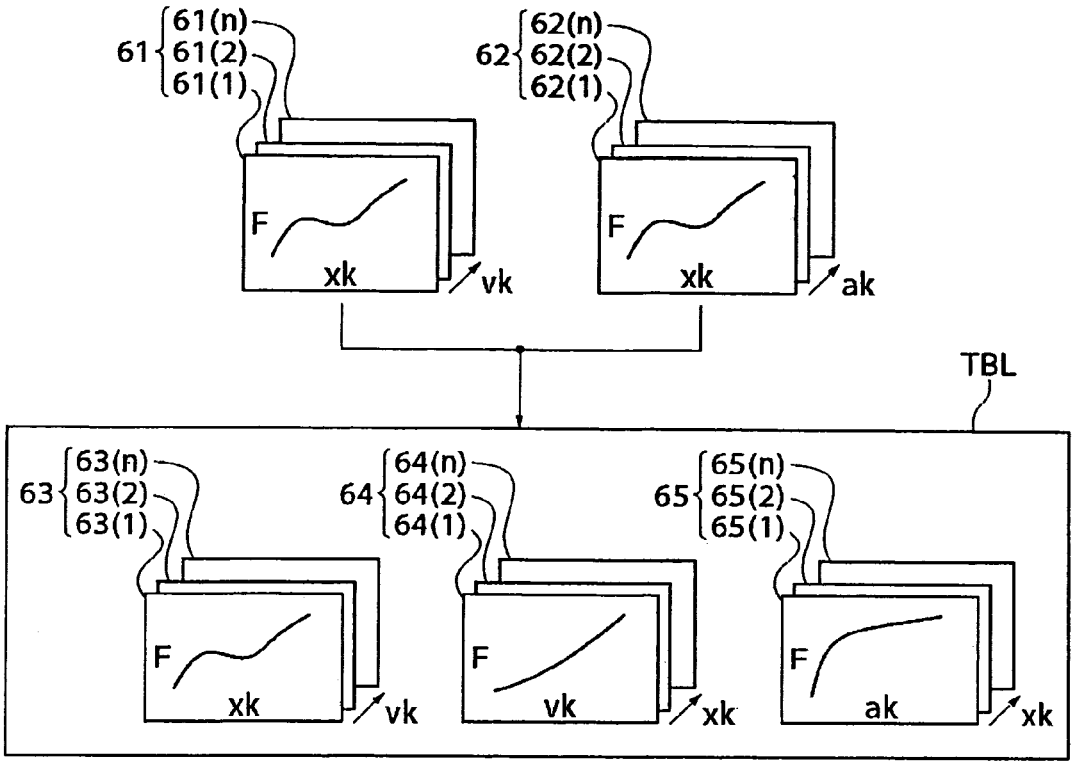
FIG. 4 is a schematic view showing a recasting work in a data acquisition system.

Upon completion of the experiments, the table producer 46 converts the pieces of force data pk at the respective current key positions xk or respective values of the plunger stroke to the piece of thrust data F through the access to the table shown in FIG. 3. As a result, the relation between the thrust F and the current key position xk is determined for each value of the key velocity, and a set of tables 61, which contains n tables 61(1), 61(2) . . . 61(*n*), is prepared for each of the black and white keys 31*a*/31*b* as shown in FIG. 4. Similarly, the relation between the thrust F and the current key position xk is determined for each value of the key acceleration ak, and a set of tables 62, which contains n tables 62(1), 62(2), . . . 62(*n*), is prepared for each of the black and white keys 31*a*/31*b*.

The table producer 46 analyzes the relations stored in the set of tables 61 and relations stored in the set of tables 62, and determines the individuality of the acoustic piano 1. The table producer 46 takes the individuality of the acoustic piano 1 into account, and recasts the relations stored in the sets of tables 61 and 62 into a relation between the thrust F and the key position xk at different values of key velocity vk, a relation between the thrust F and the key velocity vk at different values of the key position xk and a relation between the thrust F and the key acceleration at different values of the key position xk. These relations are stored in the table producer 46 in the form of three sets of tables 63, 64 and 65 for each of the black and white keys 31*a*/31*b* as shown in FIG. 4. The three sets of tables 63, 64 and 65 form a group of tables or a table group TBL for each of the black and white keys 31*a*/31*b* so that eighty-eight groups of tables are prepared for the eighty-eight black and white keys 31*a*/31*b*. Thus, the pieces of inner force sense data are stored in the table group TBL, i.e., the eighty-eight groups of tables 63, 64 and 65.

The tables 63, 64 and 65 are output from the controller DP to a suitable information storage medium (not shown), or are transferred through a communication network to an external data source. The tables 63, 64 and 65 are loaded into an inner force sense controller, which may be similar in system configuration to the prior art inner force sense controller disclosed in Japanese Patent Application laid-open No. Hei 10-177378. While a pianist is performing a piece of music on an electronic piano, the inner force sense controller gives rise to the unique piano key touch by virtue of the inner force sense data stored in the tables 63, 64 and 65.

As will be understood from the foregoing description, the data acquisition system 3*b* according to the present invention gathers the pieces of force data pk and pieces of key motion data such as the pieces of key position data and pieces of key velocity data through the experiments, and produces the pieces of inner force sense data through the data processing. In other words, any human researcher does not participate in the preparation of the inner force sense data.

System Configuration of Controller

Figure 5:
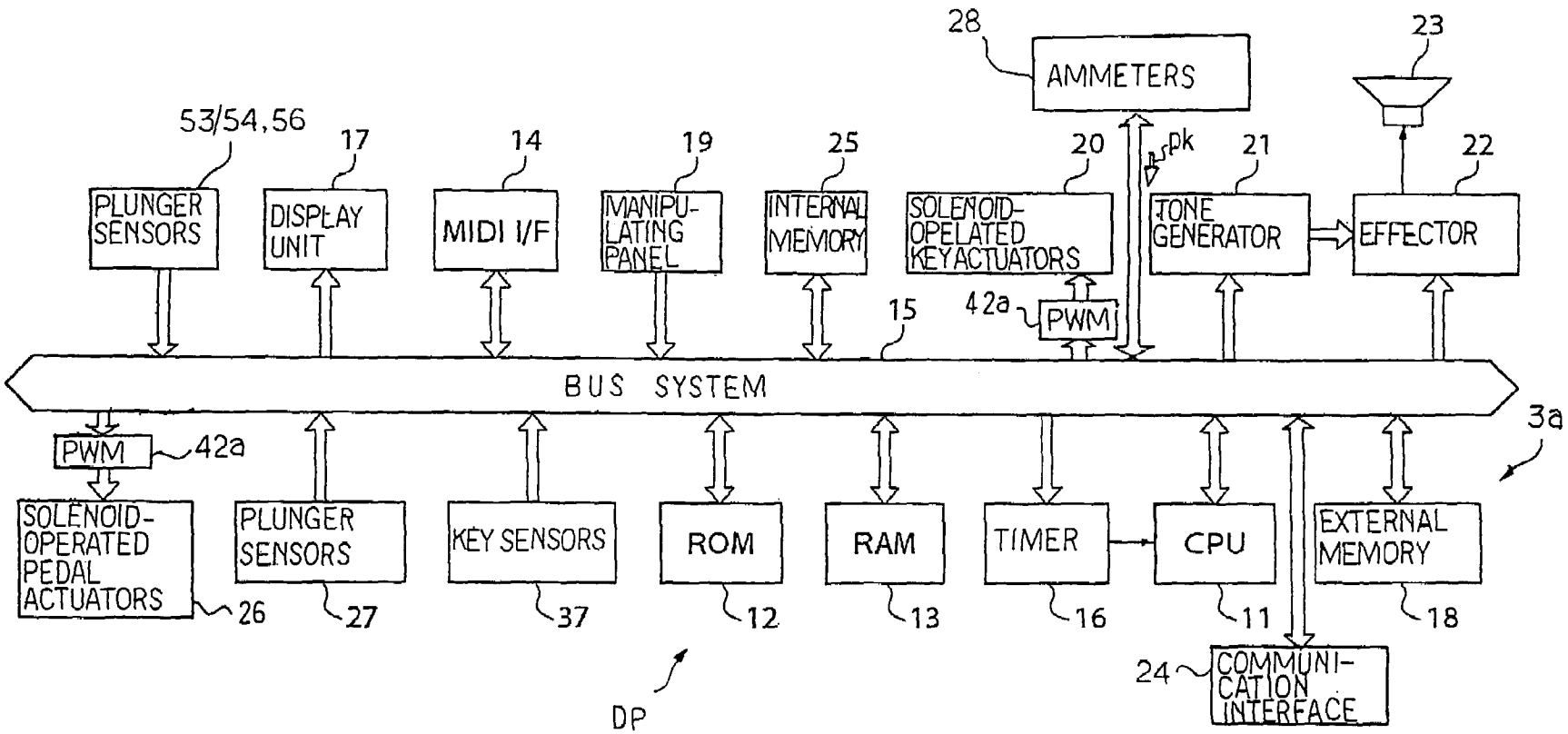
FIG. 5 is a block diagram showing the system configuration of a controller incorporated in the automatic player piano.

Turning to FIG. 5, the controller DP includes a central processing unit 11, which is abbreviated as "CPU", a read only memory 12, which is abbreviated as "ROM", a random access memory 13, which is abbreviated as "RAM", a MIDI interface 14, which is abbreviated as "MIDI/IF", a bus system 15 and a timer 16. The central processing unit 11, read only memory 12, random access memory 13, MIDI interface 14 and timer 16 are connected to the bus system 15 so that the central processing unit 11 communicates with other system components through the bus system 15.

The central processing unit 11 is the origin of the data processing capability, and computer programs are stored in the read only memory 12. The central processing unit 11 sequentially fetches program instructions, which form in combination the computer programs, from the read only memory 12, and performs a data processing. The computer programs, which selectively run on the central processing unit 11, realize the functions of piano controller 40, motion controller 41, servo controller 42 and table producer 46.

Parameter tables and coefficients, which are required for the data processing, are further stored in the read only memory 12. The table shown in FIG. 3 is also stored in the read only memory 12. The pieces of test data, which is representative of the reference test trajectories, are further stored in the read only memory 12, and the central processing unit 11 determines the relations stored in the tables 61 and 62 through the experiments.

The random access memory 13 offers temporary data storage to the central processing unit 11, and serves as a working memory. While a computer program is running on the central processing unit 11 for the data acquisition, the pieces of force data pk, pieces of position data xk and pieces of velocity data vk are memorized in the random access memory 13, and the pieces of acceleration data ak are also written in the random access memory 13. Predetermined memory locations in the random access memory 13 serve as flags indicative of the current status during the data processing. When a user instructs the central processing unit 11 to reenact a performance, a set of MIDI music data codes is transferred to the random access memory 13, and the central processing unit 11 starts to search the set of MIDI music data codes for a MIDI music data code or codes to be presently processed.

The MIDI interface 14 is connected to another musical instrument or a personal computer system through a MIDI cable, and MIDI music data codes are output from or input into the MIDI interface 14. The lapse of time is measured with the timer 16, and the central processing unit 11 reads the time or lapse of time on the timer 16 so as to determine the timing at which an event is to occur. Moreover, the timer 16 periodically causes the main routine program to branch to subroutine programs through timer interruption. The timer 16 may be a software timer.

The controller DP further includes a display unit 17, a manipulating panel 19, the pulse width modulators 42*a*, a tone generator 21, an effector 22, an internal data memory 25 such as, for example, a hard disk driver, communication interface 24 and other interfaces (not shown), which are connected to an external memory 18, key sensors 37, plunger sensors 27, built-in plunger sensors 53/54 and 56, ammeters 28 and a sound system 23. These system components 17, 19, 42*a*, 21, 22, 25 and interfaces (not shown) are also connected to the bus system 15 so that the central processing unit 11 is also communicable with those system components 17-25 and interfaces. The pulse width modulator 42*a* may be integrated with the solenoid-operated key actuators 20. In this instance, the central processing unit 11 supplies a control signal indicative of the target duty ratio of the driving signals uk(t) and up(t) through an interface to the pulse width modulators 42*a*.

The display unit 17 is a man-machine interface. In this instance, the display unit 17 includes a liquid crystal panel. Character images for status messages and prompt messages are produced in the display unit 17, and symbols and images of scales/indicators are further produced in the display unit 17 so that the users acquire status information representative of the current status of the automatic player piano 30 from the display unit 17. Images of notes on the staff notation are further produced on the display unit 16, and the users play pieces of music with the assistance of the notes on the staff notation.

Button switches, ten keys and levers are arrayed on the manipulating panel 19. The users selectively push and move the switches, keys and levers so as to give their instructions to the controlling system 3*a*.

The pulse width modulator 42*a* is responsive to pieces of control data representative of the mean current of the driving signals UK(t)/up(t) so as to adjust the driving signals UK(t)/up(t) to the target duty ratio.

The tone generator 21 produces a digital audio signal on the basis of the MIDI music data codes, and supplies the digital audio signal to the effector 22. The effector 22 is responsive to the control data codes representative of effects to be imparted to the tones so that the digital audio signal is modified in the effector 22. A digital-to-analog converter is incorporated in the effector 22. The digital audio signal is converted to an analog audio signal, and the analog audio signal is supplied to the sound system 23. The analog audio signal is equalized and amplified, and, thereafter, converted to electronic tones. Thus, the keyboard musical instrument can produce the electronic tones instead of the piano tones generated through the vibrating strings 34.

The internal data memory 25 is much larger in data holding capacity than the random access memory 13, and sets of MIDI music data codes are stored in the internal data memory 25. In this instance, the hard disk driver is used as the internal data memory 25. Sets of MIDI music data codes are transferred from the external data source (not shown) through the communication interface 24 to the internal data memory 25 or from the external memory 18 through the interface (not shown). Various sorts of large-capacity memories are available for the controller 3*a*.

In this instance, the external memory 18 is implemented by a driver or a data reader for portable memory devices such as, for example, flexible disks, compact disks or a flash memory. The key sensors 37 are provided under the front portions of the black and whit keys 31*a*/31*b*, and form parts of the recording system. The key sensors 37 are respectively associated with the black and white keys 31*a*/31*b*, and report the current key positions of the associated black and white keys 31*a*/31*b* to the controller DP. The controller DP analyzes the current key positions so as to determine the key motion. The controller DP codes the pieces of music data, which express the key motion, into the formats defined in the MIDI protocols. Thus, the performance on the keyboard 31 is recorded in a set of MIDI music data codes.

Description is made on a method of the data acquisition in more detail. The central processing unit 11, which serves as table producer 46, proceeds with the experiments as follows:

a) Each solenoid-operated key actuator 20 stepwise projects the plunger 52 so as to give rise to the stepwise key motion from the rest position to the end position along the reference test trajectory; the solenoid-operated key actuator 20 makes the brief stops at the predetermined current key positions on the reference test trajectory so as to determine the amount of current ik at each brief stop; and the amount of current ik at all the brief stops is stored in the random access memory 13:

b) Each solenoid-operated key actuator 20 stepwise retracts the plunger 52 so as to give rise to the stepwise key motion from the end position to the rest position along the reference test trajectory; the solenoid-operated key actuator 20 makes the brief stops at the predetermined current key positions on the reference test trajectory so as to determine the amount of current ik at each brief stop; and the amount of current ik at all the brief stops is stored in the random access memory 13:

c) Each solenoid-operated key actuator 20 constantly projects the plunger 52 so as to give rise to the uniform key motion from the rest position to the end position along the reference test trajectory at the first value of the key velocity; plural data acquisition points are predetermined along the reference test trajectory, and the amount of current ik is measured at every data acquisition point; the key velocity is changed to another value, and the solenoid-operated key actuator 20 gives rise to the uniform key motion at another value of the key velocity so that the amount of current ik is measured at every data acquisition point, again; the uniform key motion is n times repeated at difference values of key velocity, and the amount of current ik is measured at the data acquisition points; and the amount of current at all the data acquisition points at all values of key velocity is stored in the random access memory 13:

d) Each solenoid-operated key actuator 20 continuously retracts the plunger 52 so as to give rise to the uniform key motion from the end potion to the rest position along the reference test trajectory at the first value of the key velocity; the amount of current ik is measured at every data acquisition point, and the table producer 46 repeats the measurement at different values of the key velocity; and the amount of current ik at all the data acquisition points at all values of key velocity is stored in the random access memory 13:

e) Each solenoid-operated key actuator 20 acceleratedly projects the plunger 52 so as to give rise to the uniformly accelerated key motion from the rest position to the end position along the reference test trajectory at the first value of the key acceleration, and the amount of current ik is measured at every data acquisition point; the key acceleration is changed to another value, and the solenoid-operated key actuator 20 gives rise to the uniformly accelerated key motion at another value of the key acceleration so that the amount of current ik is measured at every data acquisition point, again; the uniformly accelerated key motion is n times repeated at difference values of key acceleration, and the amount of current ik is repeatedly measured at the data acquisition points; and the amount of current ik at all the data acquisition points at all the values of key acceleration is stored in the random access memory 13: and f) Each solenoid-operated key actuator 20 acceleratedly retracts the plunger 52 so as to give rise to the uniformly accelerated key motion from the end potion to the rest position along the reference test trajectory at the first value of the key acceleration, and the amount of current ik is measured at every data acquisition point; the table producer 46 repeats the measurement at different values of the key velocity; and the amount of current ik at all the data acquisition points at all the values of key acceleration are stored in the random access memory 13.

The motion of each black and white key 31*a*/31*b* is expressed by the following equation of motion.

$$F=m(d^2xk/dt^2)+\rho(dxk/dt)+Kxk+C \qquad \text{Equation 1}$$

where m is the mass of the system, ρ is the coefficient of friction in the system, K is the spring constant of the system and C is the resistance of the system against the motion. In the acoustic piano 1, C is due to the friction in the action unit 33. C is so small in value that it is possible to ignore C. F is read out from the table shown in FIG. 3. As described hereinbefore, the table producer 46 accesses the table shown in FIG. 3 with the piece of force data pk representative of the amount of current ik and the piece of key position data expressing the plunger stroke xk, and reads out the piece of thrust data F from the table. The equation of motion is used as follows.

When the amount of current ik at all the brief stops is stored in the random access memory 13 through the experiments a) and b), the central processing unit 11 reads out the force F from the table shown in FIG. 3, and determines the coefficient K. Since the key velocity vk at all the brief stops is zero, the first term ($d^2xk/dt^2$) and the second term (dxk/dt) are zero, the coefficient K is expressed as F/xk.

Subsequently, when the amount of current ik at all the data acquisition points is stored in the random access memory 13 through the experiments c) and d), the central processing unit 11 reads out the force F from the table shown in FIG. 3, and determines the coefficient ρ. Since the key velocity vk is constant in the experiments c) and d), the acceleration ($d^2xk/dt^2$) is zero. The coefficient K has been known. Then, the central processing unit 11 substitutes the current key position xk and current key velocity vk for (dxk/dt) and (xk) in Equation 1, and determines the coefficient ρ.

Finally, when the amount of current ik at all the data acquisition points is stored in the random access memory 13 through the experiments e) and f), the central processing unit 11 reads out the force F from the table shown in FIG. 3, and determines the coefficient m. Since the coefficients K and ρ have been known, the central processing unit 11 substitutes the current key acceleration ak, current key velocity vk and current key position xk for ($d^2xk/dt^2$), (dxk/dt) and (xk) in Equation 1, and determines the coefficient m. The coefficients m, ρ and K are unique to the individual acoustic pianos so that the equation of motion is customized for the acoustic piano 1. Since the relation between the thrust F and the current key position xk is discrete in the tables 61 and 62, the relation between the thrust F and the current key position xk may be interpolated in each table 61(1), . . . 61(*n*), 62(1) . . . or 62(*n*) or among the tables 61(1) to 61(*n*) or 62(1) to 62(*n*).

The groups of sets of tables TBL are prepared for an inner force sense controller as follows. First, the relation between the thrust F and current key position xk is transcribed from the tables 61 to the tables 63 for pieces of inner force sense data. The relation between the thrust F and the current key positions xk at different values of key velocity vk is recast to the relation between the thrust F and the current key velocity at different current key positions xk, i.e., other pieces of inner force sense data through the interpolation by using the motion of equation. Similarly, the relation between the thrust F and the current key position xk at different values of key acceleration ak is recast to the relation between the thrust F and the key acceleration ak at different current key positions xk, i.e., other pieces of inner force sense data through the interpolation by using the equation of motion. Thus, the tables 64 and 65 are prepared on the basis of the tables 61 and 62.

When the groups of sets of tables TBL are completed for all the black and white keys 31*a*/31*b*, the central processing unit 11 transfers the groups of sets of table TBL from the random access memory 13 to the internal memory 25. The central processing unit 11 may further transfer the groups of sets of tables TBL, i.e., the pieces of inner force sense data from the internal memory 25 to an information storage medium such as a floppy disk through the external memory 18. Otherwise, the central processing unit 11 transfers the groups of sets of tables TBL from the communication interface 24 through a communication network to an external data source (not shown).

The pieces of inner force sense data are used in the inner force sense control as follows. The electronic piano disclosed in Japanese Patent Application laid-open No. Hei 10-177378 may be used as a keyboard musical instrument on which the inner force sense is controlled. In order to make the keyboard musical instrument on which the inner force sense is controlled distinguishable from the keyboard musical instrument shown in FIG. 1, the keyboard musical instrument shown in FIG. 1 is referred to as "primary keyboard musical instrument", and the other keyboard musical instrument is called as "secondary keyboard musical instrument". Although the secondary keyboard musical instrument has neither key action unit nor damper, a user specifies the tones to be produced through the keyboard, and the keyboard produces key touch different from the unique piano key touch.

The inner force sense controlling system includes an array of solenoid-operated reactive force generating units, an array of key position sensors and an inner force sense controller connected to the solenoid-operated reactive force generating units. The array of solenoid-operated reactive force generating units is corresponding to the array of solenoid-operated key actuators 20, and is provided under the front portions of the black and white keys. The array of key position sensors monitors the keyboard to see whether or not the user depresses and releases any key, and supplies key position signals representative of the current key positions to the inner force sense controller.

The pieces of inner force sense data are loaded into the inner force sense controller. While a user is fingering on the keyboard, the inner force sense controller periodically checks the data input port assigned to the key position signals for the depressed keys and released keys.

The user is assumed to depress one of the black and white keys. The associated key position sensor continuously reports the current key position to the inner force sense controller, and the inner force sense controller periodically fetches the pieces of key position data from the data input port. The pieces of key position data are accumulated in the internal memory, and the inner force sense controller calculates the current key velocity and current key acceleration on the basis of the accumulated key position data.

The inner force sense controller selects one of the sets of tables 63, 64 and 65 which is corresponding to the depressed key, from the groups TBL, and accesses the tables 63, 64 and 65 with pieces of key motion data expressing the current key position, current key velocity and current key acceleration. Then, pieces of reactive force data representative of the reactive force are read out from the tables 63, 64 and 65. The reactive force is corresponding to the thrust F. If the current key position, current key velocity and current key acceleration have intermediate values among the tables 63(1) to 63(*n*), 64(1) to 64(*n*) and 65(1) to 65(*n*), the pieces of reactive force data are determined through the interpolation.

The inner force sense controller determines the magnitude of reactive force on the basis of the pieces of reactive force data, and adjusts the driving signal to the amount of current equivalent to the magnitude of reactive force. The inner force sense controller may supply the driving signal to the solenoid-operated reactive force generating unit. The solenoid-operated reactive force generating unit projects the plunger upwardly, and exerts the reactive force against the depressed key. The magnitude of reactive force is varied together with the keystroke so that the inner force sense system makes the user feel the keys similar to those of the acoustic piano 1.

As will be appreciated from the foregoing description, the data acquisition system according to the present invention produces the pieces of inner force sense data from the pieces of force data pk and pieces of key motion data through the experiments and data processing. Although the researcher participates in the preparatory work on the table shown in FIG. 3, the data acquisition system completes the groups of sets of tables 63, 64 and 65 without any assistance of the researcher. Thus, the data acquisition system according to the present invention automatically prepares the pieces of inner force sense data for the secondary keyboard musical instrument.

The data acquisition system 3*a* shares many system components such as, for example, the solenoid-operated key actuators 20 with the built-in plunger sensors 53/54 and 56 and the hardware of the controller DP with the automatic playing system 3*a*. In other words, it is necessary for the manufacturer to prepare and install the computer program for the data acquisition in the program memory. Thus, the data acquisition system 3*a* incorporated in the automatic player piano is economical.

Second Embodiment

Figure 6:
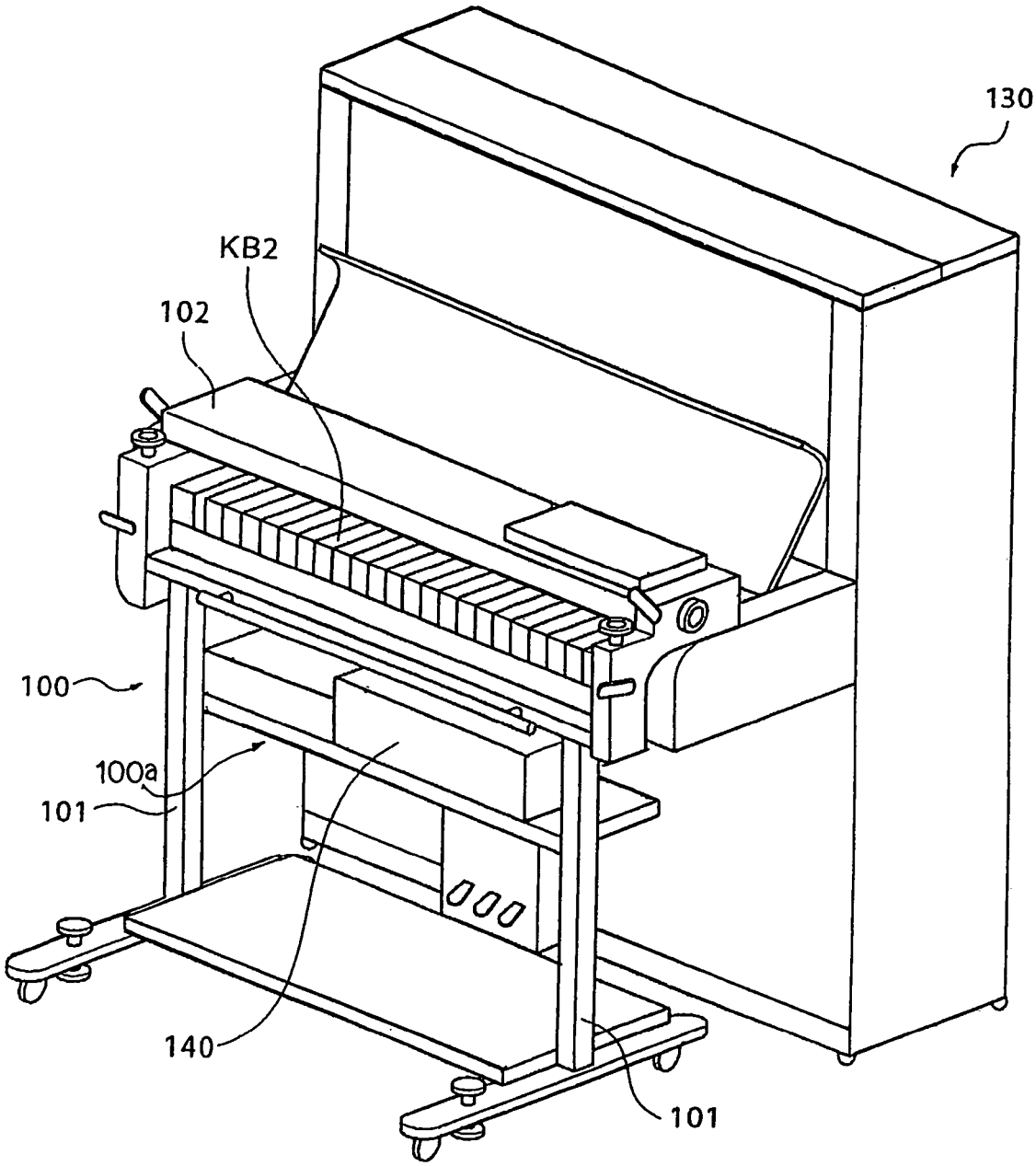
FIG. 6 is a perspective view showing another data acquisition system of the present invention.

Turning to FIG. 6, another data acquisition system 100*a* is incorporated in a separate type automatic player 100. The separate type automatic player 100 is provided for an upright piano 130. The separate type automatic player 100 not only reenacts a performance on the upright piano 130 but also serves as the data acquisition system 100*a*. For this reason, both computer programs are installed in the automatic player 100 for the playback and data acquisition. In case where the separate type automatic player disclosed in Japanese Patent Application No. 2004-124965 is retrofitted, only the computer program for the data acquisition is further installed in the program memory of the separate type automatic player.

The automatic player 100 includes a key drive unit 102 and a controller 140, and the controller 140 is connected to the key drive unit 102 through a bundle of cables. The electric power may be directly supplied from a power source to the key drive unit 102 or from the power source through the controller 140 to the key drive unit 102. A buttery (not shown) may be provided inside the controller 140.

The controller 140 is put on a rack 101, and the rack 101 is movable on the floor by means of casters. On the other hand, the key drive unit 102 is provided over a keyboard KB2, and the side arms of the upright piano 130 or key blocks bear the key drive unit 102.

Figure 7:
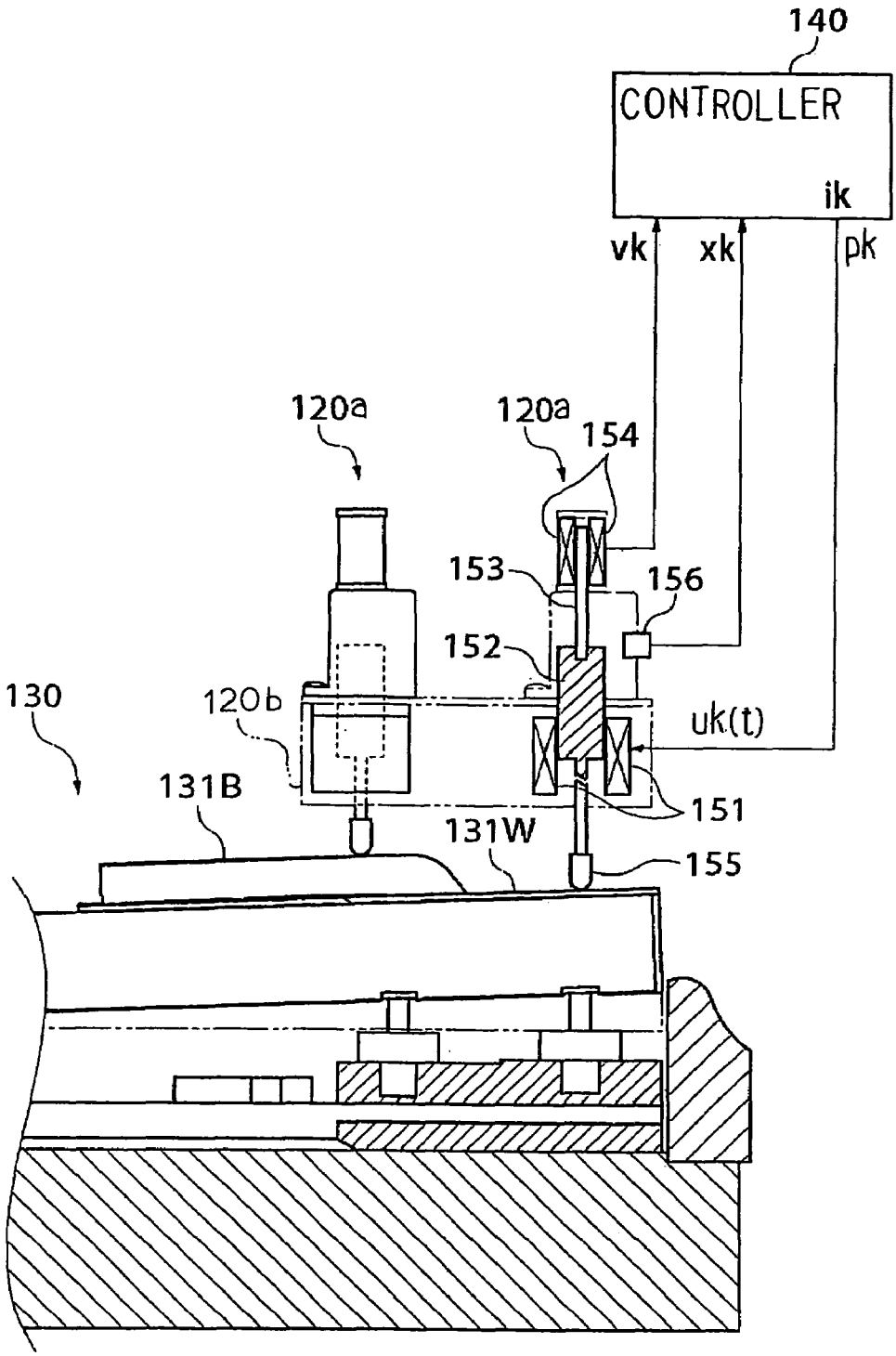
FIG. 7 is a schematic cross sectional view showing the structure of solenoid-operated key actuators incorporated in the data acquisition system.

Turning to FIG. 7, the key drive unit 102 includes solenoid-operated key actuators 120*a*, and a yoke 120*b* is shared among the solenoid-operated key actuators 120*a*. Since the front ends of the black keys 131B are retracted from the front ends of the white keys 131W, the solenoid-operated key actuators 120*a* for the black keys 131B are backwardly spaced from the solenoid-operated key actuators 120*a* for the white keys 131W. Since the solenoid-operated key actuators 120*a* are similar in structure to one another, description is made on one of the solenoid-operated key actuator 120*a* over the white key 131W.

The solenoid-operated key actuator 120 includes a solenoid 151 supported by the yoke 120*b*, a plunger 152 extending in the up-and-down direction through the solenoid 151 and a resilient cap 155. Although these component parts 151, 152 and 155 are directed in the direction opposite to the direction of the corresponding component parts 51, 52 and 55, the solenoid 151, plunger 152 and resilient cap 155 are similar to the solenoid 51, plunger 52 and resilient cap 55, and no further description is hereinafter incorporated for the sake of simplicity. A plunger velocity sensor, which is implemented by a combination of a permanent magnetic rod 153 and a coil 154, and a plunger position sensor 156 are built in the solenoid-operated key actuator 120*a*, and are similar in structure to the built-in plunger sensors 53/54 and 56. For this reason, description on the built-in sensors 153/154 and 156 is omitted for avoiding undesirable repetition.

Though not shown in FIG. 7, ammeters are provided for the driving signals. Thus, the controller 140, which serves as a table producer, acquires the pieces of key position data xk, pieces of key velocity data vk and pieces of force data pk as similar to the controller DP.

While the separate type automatic player 100 is reenacting a performance on the upright piano 130, the controller 140 realizes the functions of the piano controller 40, motion controller 41 and servo controller 42, and selectively drives the solenoid-operated key actuators 120*a* to depress and release the black and white keys 131B/131W. On the other hand, while the computer program for the data acquisition is running on the controller 140, the functions of the table producer 46, motion controller 41 and servo controller 42 are realized, and the groups of sets of tables TBL is prepared for an inner force sense controlling system. The table shown in FIG. 3 is also stored in the controller 140. Thus, the separate type automatic player 100 behaves as similar to the automatic playing system 3*a* and data acquisition system 3*b*.

However, the electronic tones are not produced in the separate type automatic player 100. Moreover, the pedals of the upright piano 130 are not controlled in the playback, and the performance on the keyboard 130 is not recorded. Accordingly, the array of key sensors 37, pedal actuators 26 and pedal sensors 27 are not incorporated in the separate type automatic player 100, and the tone generator 21, effectors 22 and sound system 23 are removed from the system configuration shown in FIG. 5.

The data acquisition system 100*a* achieves all the advantages of the data acquisition system 3*b*. Moreover, a user can combine the separate type automatic player 100 with another acoustic piano. This results in that the data acquisition system 100*a* can prepare the groups of sets of tables TBL, which express the unique piano key touch of various acoustic pianos. For example, it is possible to transplant the unique key touch of a famous acoustic piano to a popular keyboard musical instrument in cooperation with an inner force sense controlling system. Thus, the data acquisition system 100*a* is available for the acoustic piano without any automatic playing system.

MODIFICATIONS

Although the particular embodiments of the present invention have been shown and described, it will be apparent to those skilled in the art that various changes and modifications may be made without departing from the spirit and scope of the present invention.

The acoustic piano 1 does not set any limit to the technical scope of the present invention. The data acquisition system according to the present invention may be installed in another sort of keyboard musical instrument such as, for example, a harpsichord or in another sort of musical instrument such as, for example, a percussion instrument, a typical example of which is a celesta, or a wind instrument, the key touch of which is simulated in an electronic wind instrument.

The data acquisition systems 3*b*/100*a* are not always combined with the automatic playing system. Only the data acquisition system may be incorporated in an acoustic piano. Otherwise, a separate type data acquisition system may be prepared for various keyboard musical instruments.

The data acquisition systems 3*b*/100*a* may be combined with a portable inner force sense controller. In this instance, the user prepares the groups of sets of tables TBL through the data acquisition from an acoustic piano, and moves it to another keyboard musical instrument. While the user is performing a piece of music, the portable inner force sense controller imparts the unique piano key touch to the key motion. Thus, the user easily transplants the unique key touch from the acoustic piano to the keyboard musical instrument.

The tables 63, 64 and 65 do not set any limit to the technical scope of the present invention. The relation between the thrust F and the current key position/current key velocity/current key acceleration may be expressed by equations. In this instance, the inner force sense controller determines the magnitude of reactive force through the calculation.

The built-in plunger sensors 53/54 and 56 do not set any limit to the technical scope of the present invention. The sensors may be provided for the black and white keys 31*a*/31*b* independently of the solenoid-operated key actuators 20. Only one of the key position sensor, key velocity sensor and key acceleration sensor may be incorporated in the data acquisition system according to the present invention, and the other physical quantities, i.e., two of the current key position, current key velocity and current key acceleration are determined through integration and/or differentiation.

The MIDI protocols do not set any limit to the technical scope of the present invention. The pieces of music data are coded in accordance with any protocols, which the computer system can recognize.

In a data acquisition system simpler than those described hereinbefore, the table controller may directly controls the solenoid-operated key actuators. In other words, the solenoid-operated key actuators are not controlled through the servo control loops. In this instance, pieces of data, which express the stepwise key motion, uniform key motion and uniformly accelerated key motion, make the table producer control the solenoid-operated key actuators with the assistance of the pulse width modulator or another sort of driver circuit.

The data acquisition system 3*b* may further include the solenoid-operated pedal actuators 26 and plunger sensors 27. In this instance, pieces of inner force sense data for the pedals PD are further prepared as similar to those for the black and white keys 31*a*/31*b*.

The data acquisition system may further include a data converter, which converts the pieces of inner force sense data to other pieces of inner force sense data available for a secondary keyboard musical instrument different in size of the keys. For example, the secondary keyboard musical instrument may have the keys, the distance between the fulcrums and the reactive force generating units is different from the distance between the balance pins and the solenoid-operated key actuators 20. In this instance, the pieces of inner force sense data produced by the table producer 46 are to be converted to the other pieces of inner force sense data through simple arithmetic operations. Similarly, if the secondary keyboard musical instrument is equipped with return springs under or over the keys, the magnitude of reactive force is to be increased or decreased. Thus, the data converter is appreciated by users.

The table producer may ignore the individuality of the acoustic piano 1. In this instance, the groups of sets of tables TBL are directly prepared from the tables 61 and 62.

The data converter may be incorporated in the inner force sense controller. In this instance, the table producer adds pieces of instrument data expressing the dimensions of keys, total weight applied to the keys and so forth to the pieces of inner force sense data.

The inner force sense controlling system or inner force sense controller described hereinbefore is an example. Another inner force sense controlling system may locate the array of reactive force generating units over the rear portions of the keys, and another inner force sense controller may be equipped with one of or both of the key velocity sensors and key acceleration sensors. In case where the inner force sense controller determines the reactive force on the basis of one of or two of the physical quantities such as, for example, the current key position, current key velocity and current key acceleration, the data acquisition system may prepare the inner force sense data expressing relation between the magnitude of reactive force and the physical quantity or relations between the magnitude of reactive force and the physical quantities.

A data acquisition system according to the present invention may be independent of the automatic playing system in order to gather the pieces of inner force sense data. In other words, the computer program for the playback is not installed in the data acquisition system.

What is claimed is:

1. A data acquisition system for preparing pieces of inner force sense data expressing a touch on manipulators of a musical instrument, comprising:

plural actuators provided in association with said manipulators, and responsive to driving signals so as to give rise to motion of said manipulators along reference test trajectories;

plural sensors producing detecting signals representative of physical quantity expressing said motion of said manipulators;

other sensors producing other detecting signals representative of the magnitude of force exerted on said manipulators by means of said plural actuators along said reference test trajectories; and a controller connected to said plural actuators, said plural sensors and said other sensors, responsive to pieces of test data so as to give rise to said motion of said manipulators by means of said plural actuators, and analyzing said physical quantity and said magnitude of said force so as to determine relation between said motion and said magnitude of force along said reference test trajectories, thereby preparing said pieces of inner force sense data on the basis of said relation for manipulators of another musical instrument.

2. The data acquisition system as set forth in claim 1, in which said physical quantity stands for at least a current position of the manipulator on said reference test trajectory so that said relation includes a first sort of relation between said current position and said magnitude of said force at different values of current velocity of said manipulator.

3. The data acquisition system as set forth in claim 2, in which said relation further includes a second sort of relation between a current velocity of said manipulator on said reference test trajectory and said magnitude of said force at different values of said current position.

4. The data acquisition system as set forth in claim 3, in which said relation further includes a third sort of relation between a current acceleration of said manipulator on said reference test trajectory and said magnitude of said force at different values of said current position.

5. The data acquisition system as set forth in claim 1, in which said physical quantity stands for at least a current velocity of the manipulator on said reference test trajectory so that said relation includes a sort of relation between said current velocity and said magnitude of said force at different values of current position of said manipulator.

6. The data acquisition system as set forth in claim 5, in which said relation further includes another sort of relation between a current position of said manipulator on said reference test trajectory and said magnitude of said force at different values of said current velocity.

7. The data acquisition system as set forth in claim 6, in which said relation further includes yet another sort of relation between a current acceleration of said manipulator on said reference test trajectory and said magnitude of said force at different values of said current position.

8. The data acquisition system as set forth in claim 1, in which said physical quantity stands for a current position of the manipulator and a current velocity of said manipulator on the reference test trajectory so that said relation includes a first sort of relation between said current position and said magnitude of said force at different values of current velocity of said manipulator and a second sort of relation between a current velocity of said manipulator on said reference test trajectory and said magnitude of said force at different values of said current position.

9. The data acquisition system as set forth in claim 8, in which said relation further includes a third sort of relation between a current acceleration of said manipulator on said reference test trajectory and said magnitude of said force at different values of said current position.

10. The data acquisition system as set forth in claim 1, in which said other sensors measure the amount of electric current supplied to the associated plural actuators, and said physical quantity stands for at least current positions of said manipulators so that said controller determines said magnitude of force through an access to relation between said amount of electric current and current positions of said manipulators at different values of said magnitude of said force.

11. The data acquisition system as set forth in claim 10, in which said physical quantity further stands for current velocity of said manipulators on said reference test trajectories so that said controller determines relation between said current positions and said magnitude of force at difference values of said current velocity and other relation between said current positions and said magnitude of force at different values of acceleration of said manipulators calculated on the basis of said current velocity before the determination of said relation between said motion and said magnitude of said force.

12. The data acquisition system as set forth in claim 1, in which said controller determines individuality of said manipulators before the determination of said relation between said motion and said magnitude of said force.

13. The data acquisition system as set forth in claim 12, in which said motion is assumed to be expressed by an equation of motion, and said individuality is expressed as coefficients in said equation of motion.

14. The data acquisition system as set forth in claim 13, in which said equation of motion is expressed as $$F=m(d^2xk/dt^2)+\rho(dxk/dt)+Kxk+C$$

where xk is a current position of each of said manipulators on the reference test trajectory, m, ρ and K and C are said coefficients.

15. The data acquisition system as set forth in claim 13, in which said equation of motion is used in a recasting work from said physical quantity and said magnitude of force to said relation.

16. The data acquisition system as set forth in claim 1, in which a computer program for preparing said pieces of inner force sense data and another computer program for an automatic playing are installed in said controller so that said data acquisition system is available for an automatic playing on said musical instrument.

17. The data acquisition system as set forth in claim 16, in which said data acquisition system is built in said musical instrument so that said pieces of inner force sense data only express said touch on said manipulators.

18. The data acquisition system as set forth in claim 16, in which said data acquisition system is physically separated from said musical instrument so that a user can combine said data acquisition system with yet another musical instrument.

19. The data acquisition system as set forth in claim 1, in which said manipulators are black keys and white keys incorporated in an acoustic piano so that said touch is unique to said black keys and said white keys.

20. The data acquisition system as set forth in claim 19, in which a computer program for an automatic playing is installed in said controller, and said controller causes said plural actuator selectively to depress and release said black keys and said white keys so as to produce tones while said computer program is running on said controller.

* * * * *